US010984726B2

(12) United States Patent
Morita et al.

(10) Patent No.: US 10,984,726 B2
(45) Date of Patent: Apr. 20, 2021

(54) DISPLAY DEVICE

(71) Applicant: Japan Display Inc., Minato-ku (JP)

(72) Inventors: Tetsuo Morita, Minato-ku (JP); Hiroyuki Kimura, Minato-ku (JP)

(73) Assignee: Japan Display Inc., Minato-ku (JP)

( * ) Notice: Subject to any disclaimer, the term of this patent is extended or adjusted under 35 U.S.C. 154(b) by 0 days.

(21) Appl. No.: 16/846,855

(22) Filed: Apr. 13, 2020

(65) Prior Publication Data

US 2020/0243019 A1 Jul. 30, 2020

Related U.S. Application Data

(63) Continuation of application No. PCT/JP2018/028228, filed on Jul. 27, 2018.

(30) Foreign Application Priority Data

Oct. 27, 2017 (JP) ..... JP2017-207994

(51) Int. Cl.
*G09G 3/3266* (2016.01)

(52) U.S. Cl.
CPC ... *G09G 3/3266* (2013.01); *G09G 2310/0286* (2013.01); *G09G 2310/06* (2013.01)

(58) Field of Classification Search
None
See application file for complete search history.

(56) References Cited

U.S. PATENT DOCUMENTS

2009/0102824 A1 4/2009 Tanaka et al.

FOREIGN PATENT DOCUMENTS

WO WO 2007/105700 A1 9/2007

OTHER PUBLICATIONS

International Search Report dated Oct. 16, 2018 in PCT/JP2018/028228 filed Jul. 27, 2018, 1 page.

*Primary Examiner* — Aneeta Yodichkas
(74) *Attorney, Agent, or Firm* — Oblon, McClelland, Maier & Neustadt, L.L.P.

(57) ABSTRACT

A plurality of enable circuits are respectively adjacent to a display area in a first direction and connected to a plurality of control lines to output a control signal corresponding to a pulse signal. A plurality of unit circuits include a first group of unit circuits located adjacent to the display area in the first direction, and a second group of unit circuits located adjacent to the display area in a second direction. The plurality of connection lines include a first group of connection lines connected to the first group of unit circuits, and a second group of connection lines connected to the second group of unit circuits. The connection lines of the second group are longer than the connection lines of the first group.

12 Claims, 14 Drawing Sheets

DISPLAY DEVICE

CROSS-REFERENCE TO RELATED APPLICATION

This application is a continuation application of International Application PCT/JP2018/028228 filed on Jul. 27, 2018, which claims priority from Japanese patent application JP2017-207994 filed on Oct. 27, 2017. The contents of these applications are incorporated herein by reference in their entirety.

BACKGROUND OF THE INVENTION

1. Field of the Invention

The present invention relates to a display device.

2. Description of the Related Art

In recent display panels, in response to the demand for narrower frames, the corner portions of the originally rectangular display panel are rounded according to the outer shape of the housing, and the display area also has a similar shape accordingly (International Publication WO2007/105700). Furthermore, it is required to reduce the width of the frame surrounding the display area, including the rounded corner portions, as much as possible.

The scanning circuit arranged in the frame includes a shift register circuit that outputs a scanning signal to a plurality of scanning lines, and the shift register includes, for example, a multi-stage flip-flop. Since the scanning circuit is arranged along the ends of the display area, the scanning circuit can be arranged linearly in a normal rectangular display area, but at the corner portions, it is necessary to arrange the scanning circuit in a layout different from the straight side portions of the display area. Alternatively, if the scanning circuit is arranged at the corner portions in the same layout as the straight side portions, the layout efficiency is deteriorated. In particular, on the side that is electrically connected to the outside, it is necessary to arrange the routing wiring (oblique wiring), and the layout is more difficult.

Therefore, it is conceivable that the scanning circuit arranged in the corner portions is arranged in other vacant areas such as the upper or lower side of the display area. However, if the scanning circuit is arranged on the upper or lower side of the display area, since the distance from the output of the scanning circuit to the pixel circuit increases, the scanning lines become longer outside the display area. If the scanning line is long, the load increases, and the rising and falling of the applied pulse are delayed. As a result, a difference occurs in the delay or rounding of the pulse applied to the scanning line between the straight side portion and the corner portion, and there is a concern that a horizontal band may be seen in the displayed image.

SUMMARY OF THE INVENTION

An object of the present invention is to arrange a control circuit in a narrow area without increasing the load on a control line.

The display device according to the present invention includes a display area in which a plurality of pixel circuits respectively corresponding to a plurality of pixels are arranged in a first direction and a second direction intersecting each other; a peripheral area outside the display area; a plurality of control lines connected to the plurality of pixel circuits in the display area and extending in the first direction to reach the peripheral area; and a control circuit for sequentially selecting the plurality of control lines in the peripheral area, in which the control circuit includes a shift register including a plurality of unit circuits connected in multiple stages so that a pulse signal is sequentially moved and output, a plurality of enable circuits connected to the plurality of unit circuits so that the pulse signal is input, and a plurality of connection lines connecting the plurality of unit circuits and the plurality of enable circuits; the plurality of enable circuits are respectively adjacent to the display area in the first direction and connected to the plurality of control lines to output a control signal corresponding to the pulse signal; and the plurality of unit circuits include a first group of unit circuits adjacent to the display area in the first direction, and a second group of unit circuits located adjacent to the display area in the second direction; the plurality of connection lines include a first group of connection lines connected to the first group of unit circuits, and a second group of connection lines connected to the second group of unit circuits; and the connection lines of the second group are longer than the connection lines of the first group.

According to the present invention, since the plurality of unit circuits of the shift register are arranged adjacent to the display area not only in the first direction but also in the second direction, the control circuit can be arranged in a narrow area. Further, since all of the plurality of control lines are connected to the plurality of enable circuits adjacent to the display area in the first direction, there is no significant difference in the load of the control lines even though the distance from the unit circuit is different.

DETAILED DESCRIPTION OF THE INVENTION

Figure 1:
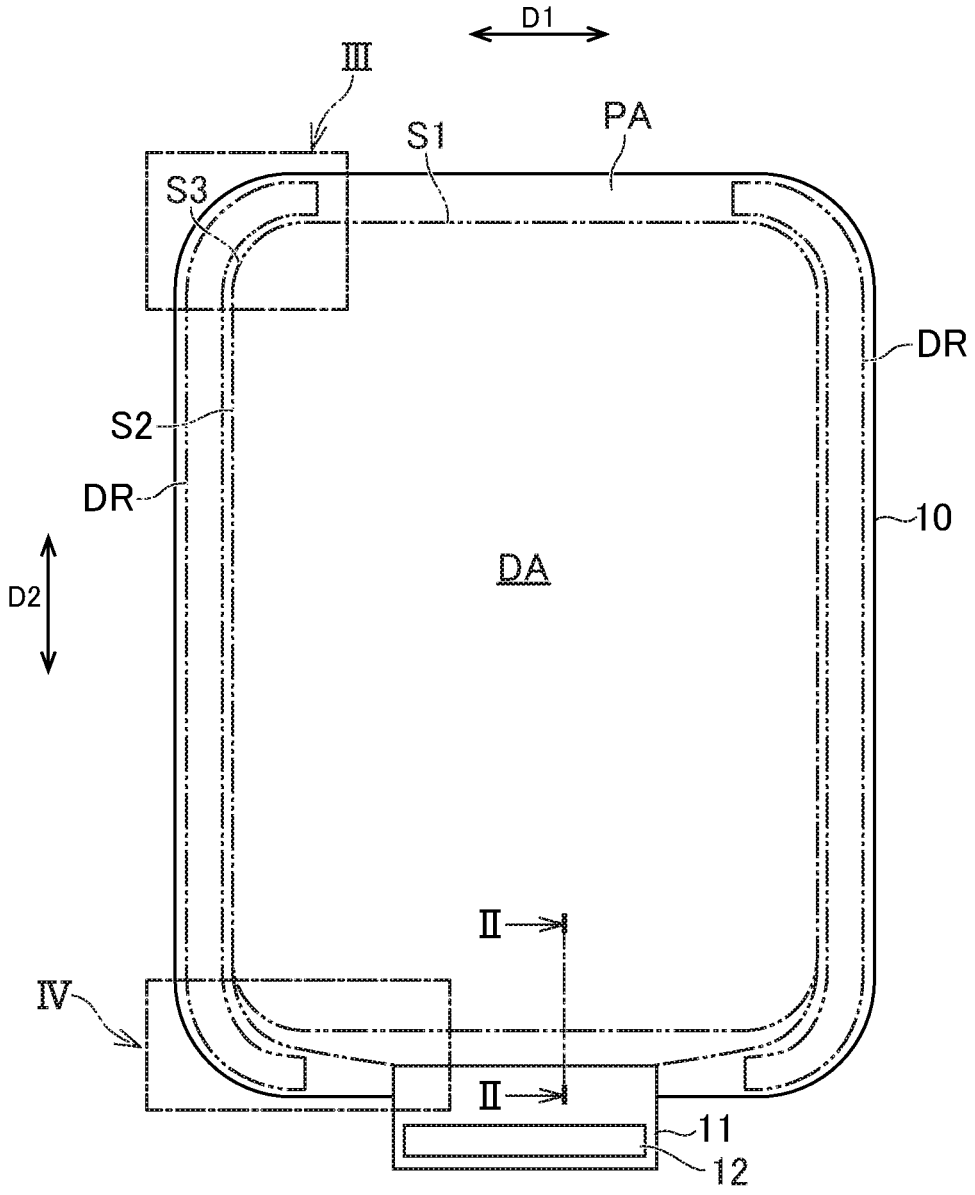
FIG. 1 is a plan view illustrating a display device according to a first embodiment to which the present invention is applied.

Hereinafter, embodiments of the present invention will be described with reference to the drawings. However, the present invention can be carried out in various modes without departing from the gist of the present invention, and is not to be construed as being limited to the description of the embodiments exemplified below.

The drawings may be schematically illustrated in terms of width, thickness, shape, and the like of each portion as compared with actual embodiments in order to make the description clearer, but are merely examples, and are not intended to limit the interpretation of the present invention. In the specification and the drawings, elements having the same functions as those described in relation to the already described drawings are denoted by the same reference numerals, and the redundant description may be omitted.

Furthermore, in the detailed description of the present invention, when defining the positional relationship between a certain component and another component, the terms "above" and "below" include not only the case where located directly above or below the certain component, but also the case where other components are further interposed therebetween unless otherwise specified.

First Embodiment

FIG. 1 is a plan view illustrating a display device according to a first embodiment to which the present invention is applied. The display device is configured to form a full-color pixel by combining unit pixels (sub-pixels) of a plurality of colors including, for example, red, green, and blue, and displays a full-color image.

The display device includes a display area DA where an image is displayed. In the example of FIG. 1, the outer shape of the display area DA includes a first side S1 extending in a first direction D1 and a second side S2 extending in a second direction D2. The first side S1 and the second side S2 are connected by a third side S3. The third side S3 extends obliquely with respect to the first direction D1 and the second direction D2. In the example of FIG. 1, the third side S3 is a curve (at least a part of which is an arc shape), and the outer shape of the display area DA is a rounded rectangle.

There is a peripheral area PA outside the display area DA. The peripheral area PA has a uniform width adjacent to the first side S1, the second side S2, and the third side S3. In the peripheral area PA, a control circuit DR (or a scanning circuit or a gate driver circuit) is provided. The flexible printed circuit board 11 is connected to the peripheral area PA. An integrated circuit 12 is mounted on the flexible printed circuit board 11.

Figure 2:
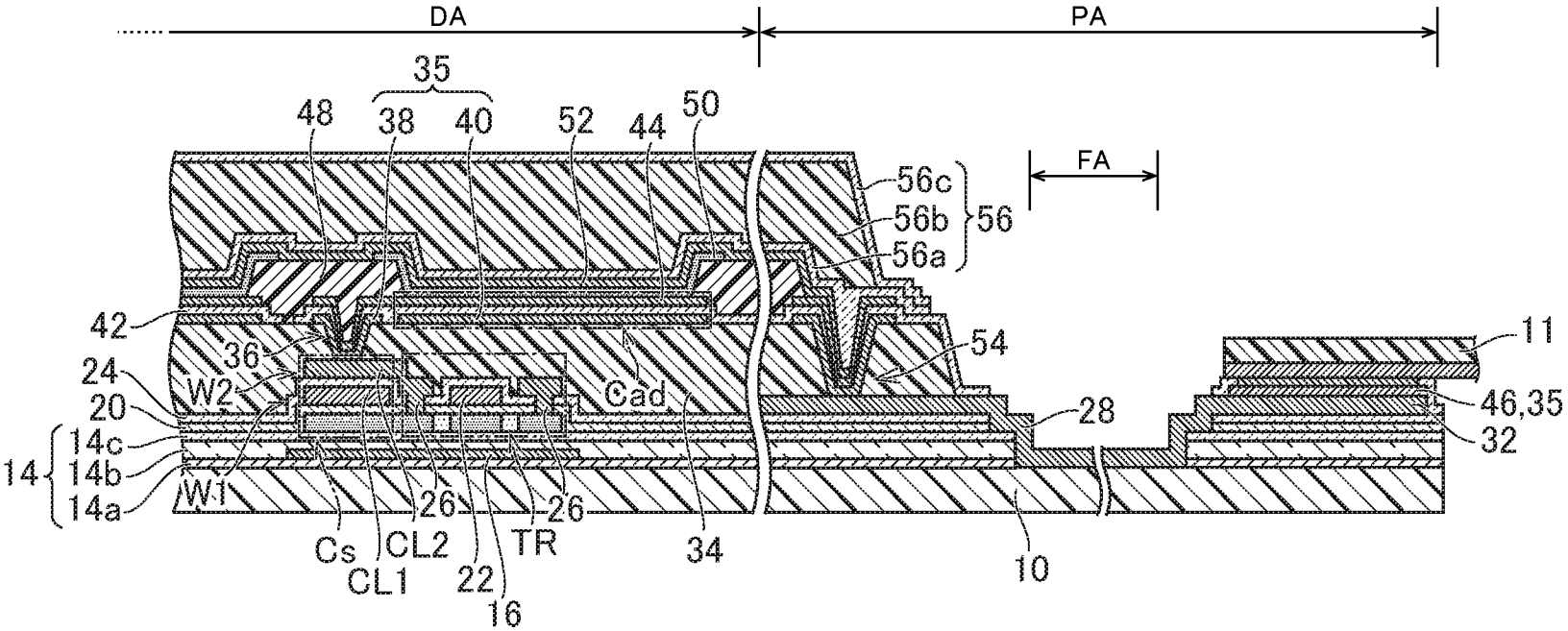
FIG. 2 is a cross-sectional view taken along line II-II of the display device illustrated in FIG. 1.

FIG. 2 is a cross-sectional view taken along line II-II of the display device illustrated in FIG. 1. Polyimide is used as a material of a substrate 10 (array substrate) and another substrate (opposite substrate, not illustrated). However, another resin material may be used as long as the material has sufficient flexibility to constitute a sheet display or a flexible display.

On the substrate 10, a three-layer laminated structure of a silicon oxide film 14*a*, a silicon nitride film 14*b*, and a silicon oxide film 14*c* is provided as an undercoat layer 14. The lowermost silicon oxide film 14*a* is provided for improving adhesion to the substrate 10, the intermediate silicon nitride film 14*b* is provided as a block film against moisture and impurities from the outside, and the uppermost silicon oxide film 14*c* is provided as a block film for preventing hydrogen atoms contained in the silicon nitride film 14*b* from diffusing to a semiconductor layer 18 side of a thin film transistor TR. However, the structure is not particularly limited to this structure, and may be further laminated, or may be a single layer or a two-layer laminate.

Under the undercoat layer 14, an additional film 16 may be formed at a position where the thin film transistor TR is formed. The additional film 16 can suppress a change in the characteristics of the thin film transistor TR due to the intrusion of light from the back surface of the channel, or can give a back gate effect to the thin film transistor TR by being formed of a conductive material and giving a predetermined potential. Here, after forming the silicon oxide film 14*a*, the additional film 16 is formed in an island shape in accordance with the position where the thin film transistor TR is to be formed, and then the silicon nitride film 14*b* and the silicon oxide film 14*c* are laminated, and thus, the additional film 16 is formed to be sealed in the undercoat layer 14. The present invention is not limited thereto. The additional film 16 may be first formed on the substrate 10, and then the undercoat layer 14 may be formed.

The thin film transistor TR is formed on the undercoat layer 14. Only an Nch transistor is illustrated here by taking a polysilicon thin film transistor as an example, but a Pch transistor may be formed at the same time. The semiconductor layer 18 of the thin film transistor TR has a structure in which a low-concentration impurity region is provided between a channel region and a source and drain region. Here, a silicon oxide film is used as a gate insulating film 20. A gate electrode 22 is a part of a first wiring layer W1 formed of MoW. The first wiring layer W1 includes a first storage capacitance line CL1 in addition to the gate electrode 22. A part of a storage capacitor Cs is formed between the first storage capacitance line CL1 and the semiconductor layer 18 (source and drain region) via the gate insulating film 20.

On the gate electrode 22, an interlayer insulating film 24 (silicon oxide film and silicon nitride film) is laminated. When allowing the substrate 10 to be bent, at least a part of the interlayer insulating film 24 is removed in a bending area FA to be easily bent. Since the undercoat layer 14 is exposed by removing the interlayer insulating film 24, at least a part thereof is also removed by patterning. After removing the undercoat layer 14, the polyimide constituting the substrate 10 is exposed. In some cases, the polyimide surface may be partially eroded through etching of the undercoat layer 14 to reduce the film thickness.

On the interlayer insulating film 24, a second wiring layer W2 including a portion serving as a source and drain electrode 26 and a routing wiring 28 is formed. Here, a three-layer laminated structure of Ti, Al and Ti is employed. The first storage capacitance line CL1 (part of the first wiring layer W1) and a second storage capacitance line CL2 (part of the second wiring layer W2) form a part of another storage capacitor Cs via the interlayer insulating film 24. The routing wiring 28 extends to an end of the substrate 10 to include a terminal 32 for connecting the flexible printed circuit board 11.

A planarizing film 34 is provided to cover the source and drain electrode 26 and the routing wiring 28 (except for a part thereof). As the planarizing film 34, an organic material such as photosensitive acrylic is often used because the organic material has better surface planarization than an inorganic insulating material formed by chemical vapor deposition (CVD) or the like.

The planarizing film 34 is removed at a pixel contact portion 36 and the peripheral area PA, and an indium tin oxide (ITO) film 35 is formed thereon. The indium tin oxide film 35 includes a first transparent conductive film 38 and a second transparent conductive film 40 separated from each other.

The second wiring layer W2 whose surface is exposed by removing the planarizing film 34 is covered with the first transparent conductive film 38. A silicon nitride film 42 is provided on the planarizing film 34 to cover the first transparent conductive film 38. The silicon nitride film 42 has an opening in the pixel contact portion 36, and a pixel electrode 44 is laminated so as to be conducted to the source and drain electrode 26 through the opening. The pixel electrode 44 is formed as a reflective electrode and has a three-layer laminated structure of an indium zinc oxide film, an Ag film, and an indium zinc oxide film. Here, the indium tin oxide film 35 may be used instead of the indium zinc oxide film. The pixel electrode 44 extends laterally from the pixel contact portion 36 and reaches above the thin film transistor TR.

The second transparent conductive film 40 is provided adjacent to the pixel contact portion 36, below the pixel electrodes 44 (further below the silicon nitride film 42). The second transparent conductive film 40, the silicon nitride film 42, and the pixel electrode 44 are overlapped to form an additional capacitor Cad.

On the surface of the terminal 32, a third transparent conductive film 46 which is another part of the indium tin oxide film 35 is formed. The third transparent conductive film 46 is formed simultaneously with the first transparent conductive film 38 and the second transparent conductive film 40. The third transparent conductive film 46 on the terminal 32 is provided as a barrier film so that an exposed portion of the terminal 32 is not damaged in a subsequent process. At the time of patterning the pixel electrode 44, the third transparent conductive film 46 is exposed to an etching environment. However, the indium tin oxide film 35 has sufficient resistance to the etching of the pixel electrode 44 by an annealing process performed between the formation of the indium tin oxide film 35 and the formation of the pixel electrode 44.

On the planarizing film 34, for example, above the pixel contact portion 36, an insulating layer 48 which is called a bank (rib) and serves as a partition between adjacent pixel regions is formed. As the insulating layer 48, photosensitive acrylic or the like is used similarly to the planarizing film 34. The insulating layer 48 is opened to expose the surface of the pixel electrode 44 as a light emitting region, and the opening end preferably has a gentle taper shape. If the opening end has a steep shape, poor coverage of an organic electro luminescence (EL) layer 50 formed thereon will occur.

The planarizing film 34 and the insulating layer 48 are in contact through an opening provided in the silicon nitride film 42 therebetween. Thus, moisture and gas desorbed and degassed from the planarizing film 34 can be extracted through the insulating layer 48 by heat treatment or the like after the formation of the insulating layer 48.

The organic EL layer 50 made of an organic material is laminated on the pixel electrode 44. The organic EL layer 50 may be a single layer, or may have a structure in which a hole transport layer, a light emitting layer, and an electron transport layer are sequentially laminated from the pixel electrode 44 side. These layers may be formed by vapor deposition, may be formed by coating over a solvent dispersion, or may be formed selectively with respect to the pixel electrode 44 (each sub-pixel). Alternatively, these layers may be formed by solid formation on the entire surface covering the display area DA. In the case of solid formation, white light can be obtained in all sub-pixels, and a desired color wavelength portion can be extracted by a color filter (not illustrated).

A counter electrode 52 is provided on the organic EL layer 50. Here, the counter electrode 52 is transparent due to the top emission structure. For example, the Mg layer and the Ag layer are formed as films thin to an extent that transmits light emitted from the organic EL layer 50. According to the above-described order of forming the organic EL layer 50, the pixel electrode 44 serves as an anode and the counter electrode 52 serves as a cathode. The counter electrode 52 is formed over the display area DA and over a cathode contact portion 54 provided near the display area DA. The counter electrode 52 is connected to the lower routing wiring 28 at the cathode contact portion 54 and electrically connected to the terminal 32.

A sealing film 56 is formed on the counter electrode 52. One function of the sealing film 56 is to prevent the previously formed organic EL layer 50 from the intrusion of moisture from the outside, and a high gas barrier property is required. Here, the laminated structure including the silicon nitride film is a laminated structure of a silicon nitride film 56*a*, an organic resin layer 56*b*, and a silicon nitride film 56*c*. A silicon oxide film or an amorphous silicon layer may be provided between the silicon nitride films 56*a* and 56*c* and the organic resin layer 56*b* for the purpose of improving adhesion.

If necessary, a cover glass, a touch panel substrate or the like may be provided on the sealing film 56. In this case, in order to fill the gap between the sealing film 56 and the cover glass or the touch panel, a filler using a resin or the like may be interposed.

Figure 3:
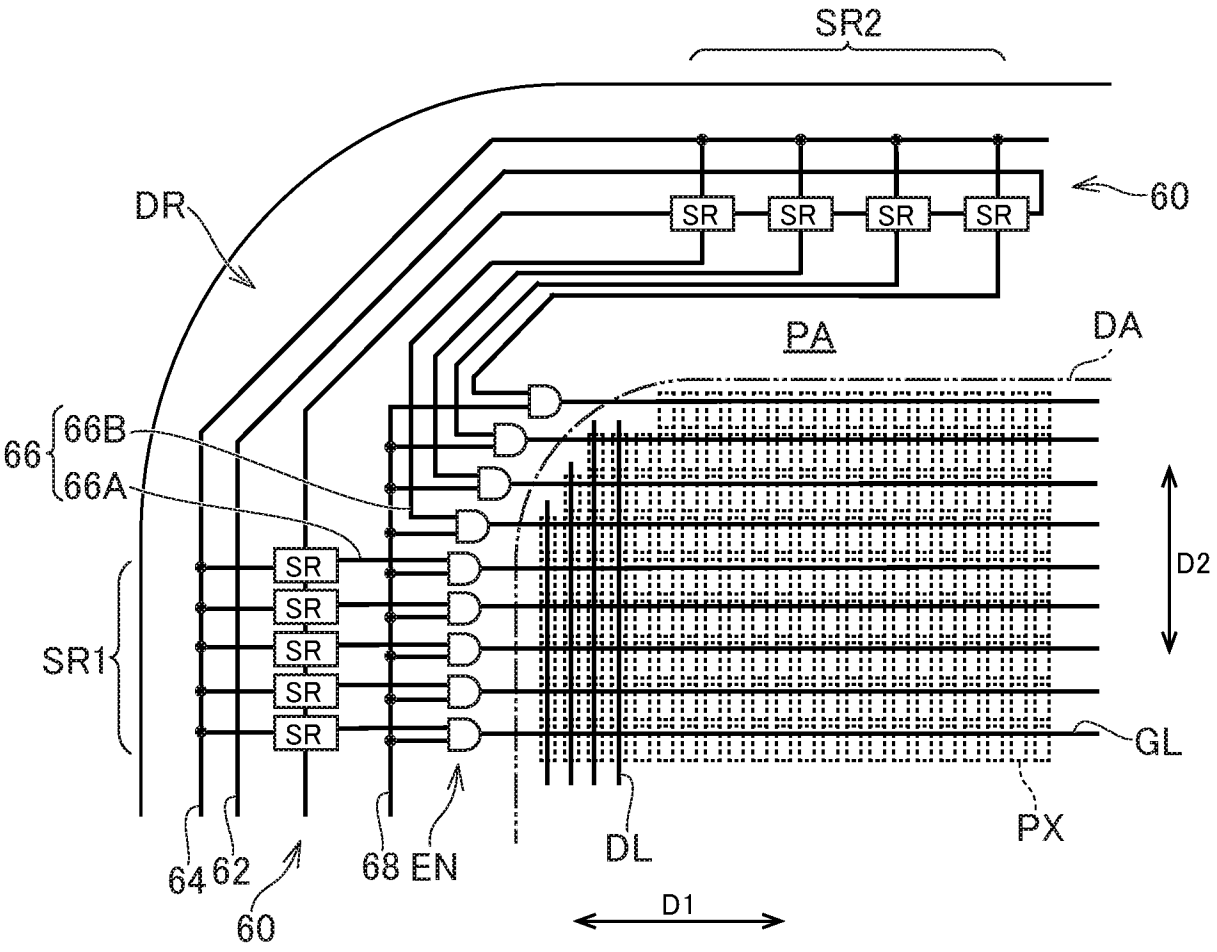
FIG. 3 is an enlarged view of a portion indicated by III in FIG. 1.
Figure 4:
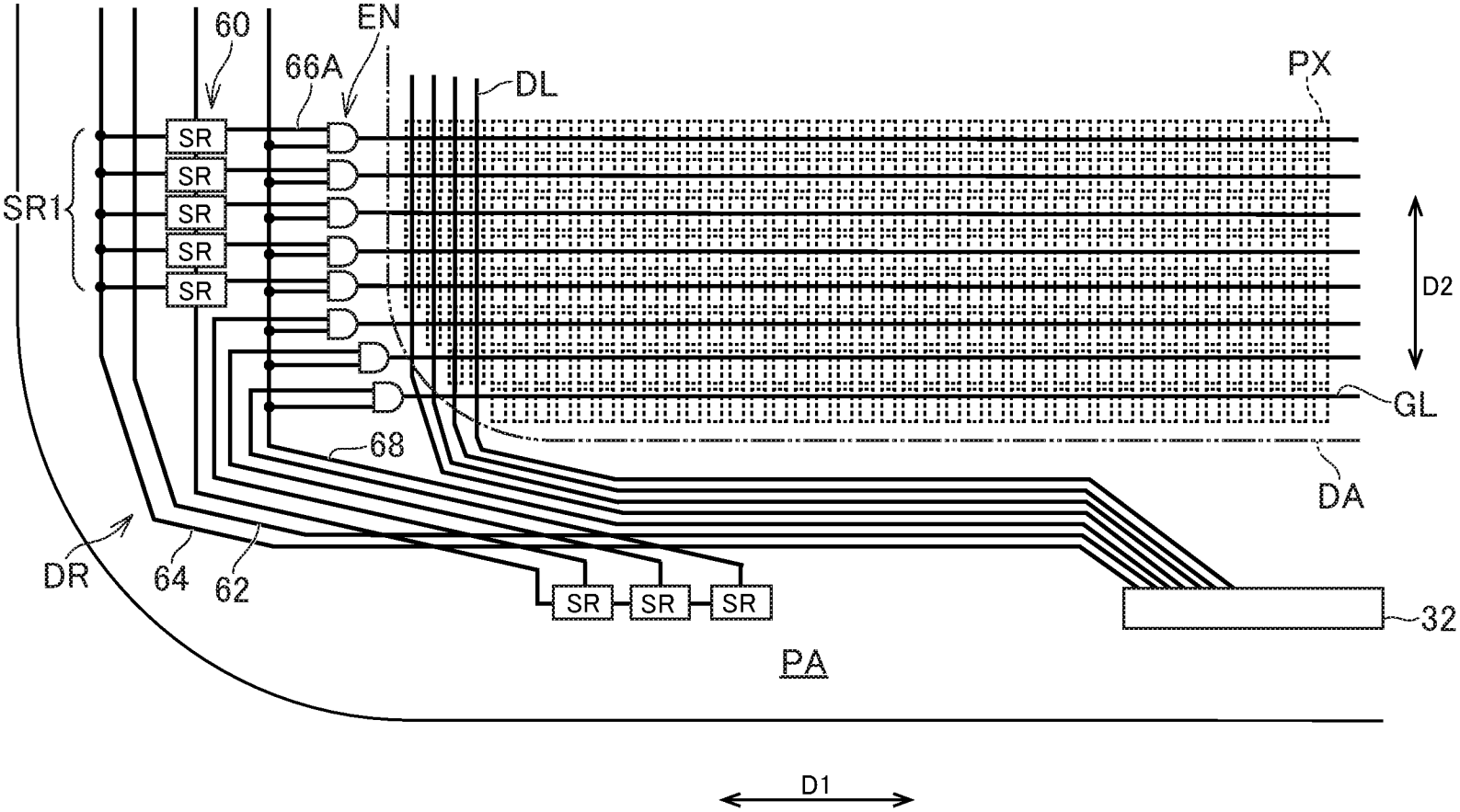
FIG. 4 is an enlarged view of a portion indicated by IV in FIG. 1.

FIG. 3 is an enlarged view of a portion indicated by III in FIG. 1. FIG. 4 is an enlarged view of a portion indicated by IV in FIG. 1. In the display area DA, a plurality of pixel circuits PX respectively corresponding to a plurality of pixels are arranged in the first direction D1 and the second direction D2 which intersect (orthogonal) with each other. A plurality of control lines GL (scanning lines) are connected to the plurality of pixel circuits PX in the display area DA and reach the peripheral area PA. The plurality of control lines GL each extend in the first direction D1. At least one control line GL is connected to several pixel circuits PX arranged in a line in the first direction D1. A plurality of video signal lines DL are provided in a direction intersecting the plurality of control lines GL, and respectively extend in the second direction D2.

Figure 5:
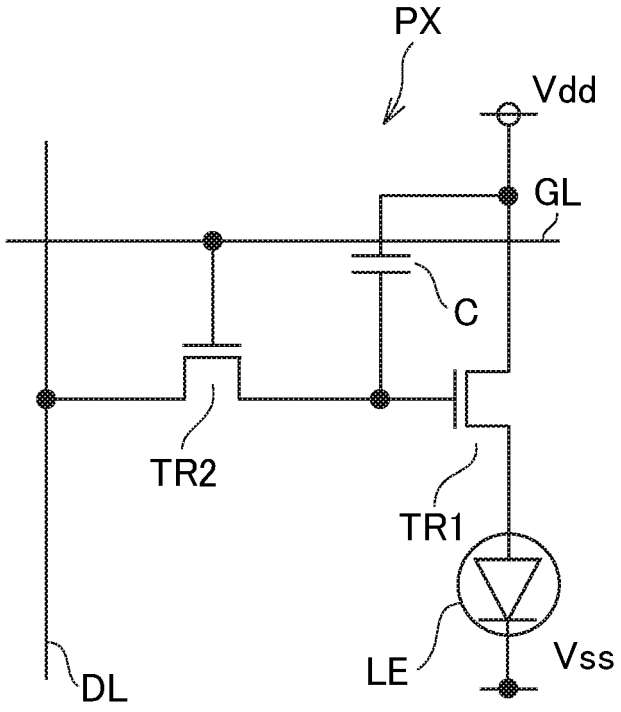
FIG. 5 is a detailed view of the pixel circuit illustrated in FIGS. 3 and 4.

FIG. 5 is a detailed view of the pixel circuit illustrated in FIGS. 3 and 4. The pixel circuit PX includes a storage capacitor C, a thin film transistor TR1, a thin film transistor TR2, the control line GL, and the video signal line DL. The gate electrode of the thin film transistor TR2 is connected to the control line GL, the source electrode is connected to the video signal line DL, and the drain electrode is connected to one end of the storage capacitor C and the gate electrode of the thin film transistor TR1. When a predetermined voltage (control signal G illustrated in FIG. 6) is applied to the gate electrode of the thin film transistor TR2, the thin film transistor TR2 applies the potential of the video signal line DL to the gate electrode of the thin film transistor TR1. The storage capacitor C holds the gate-source voltage of TR1 based on the potential of the video signal line DL, and TR1 supplies a current corresponding to the charge of the storage capacitor C from a power supply voltage Vdd to the anode of a light emitting element LE. The cathode of the light emitting element LE is connected to a power supply voltage Vss.

Figure 6:
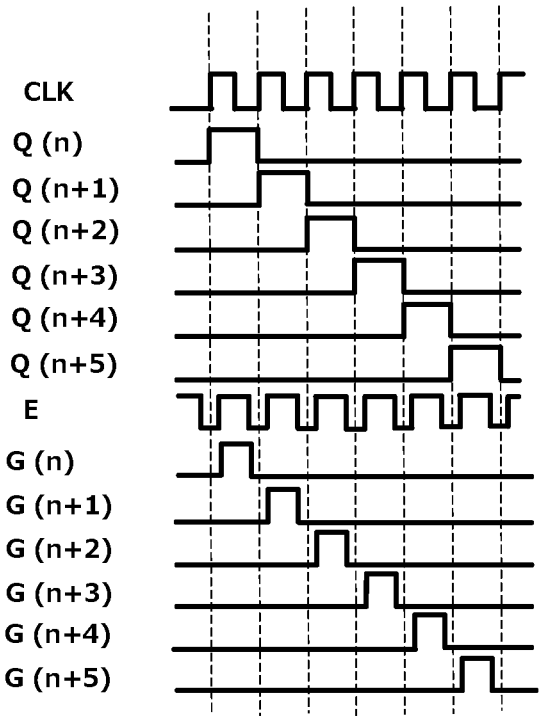
FIG. 6 is a diagram illustrating a timing chart of a control circuit for driving a pixel circuit.

As illustrated in FIGS. 3 and 4, the control circuit DR includes a shift register 60 for sequentially selecting the plurality of control lines GL. The shift register 60 includes a plurality of unit circuits SR connected in multiple stages. The plurality of unit circuits SR are formed such that a pulse signal Q (FIG. 6) is sequentially moved and output. A start pulse signal is input from a pulse signal line 62 to the first-stage unit circuit SR. A clock signal CLK (FIG. 6) is input from a clock signal line 64 to the plurality of unit circuits SR. The timing chart illustrated in FIG. 6 is an example, and the relationship between the clock signal CLK and the pulse signal Q may be different.

The plurality of unit circuits SR include a first group of unit circuits SR1 located adjacent to the display area DA in the first direction D1, and a second group of unit circuits SR2 located adjacent to the display area DA in the second direction D2. According to the present embodiment, the plurality of unit circuits SR of the shift register 60 are arranged adjacent to the display area DA not only in the first direction D1 but also in the second direction D2. The control circuit DR can be arranged in the narrow peripheral area PA. In particular, as illustrated in FIG. 4, on the side where the terminal 32 for external connection is provided, a large number of wirings are densely arranged, so that the layout of the control circuit DR is restricted, and the present embodiment is effective as a countermeasure thereof.

As illustrated in FIGS. 3 and 4, the control circuit DR includes a plurality of enable circuits EN. All of the plurality of enable circuits EN are adjacent to the display area DA in the first direction D1. The plurality of enable circuits EN are connected to the plurality of unit circuits SR so that the pulse signal Q (FIG. 6) is input. Each of the plurality of unit circuits SR is connected to a corresponding one of the plurality of enable circuits EN. The control circuit DR includes a plurality of connection lines 66 connecting the plurality of unit circuits SR and the plurality of enable circuits EN. The plurality of connection lines 66 include a first group of connection lines 66A connected to the first group of unit circuits SR1, and a second group of connection lines 66B connected to the second group of unit circuits SR2. The connection lines 66B of the second group are longer than the connection lines 66A of the first group.

The control circuit DR includes an enable line 68 for inputting an enable signal E (FIG. 6) to the plurality of enable circuits EN. Each of the plurality of enable circuits EN is an AND circuit that outputs based on a logical product. Each of the plurality of enable circuits EN is connected to the plurality of control lines GL to output the control signal G corresponding to the pulse signal Q (FIG. 6).

According to the present embodiment, all of the plurality of control lines GL are connected to the plurality of enable circuits EN adjacent to the display area DA in the first direction D1. Therefore, even though the distances from the unit circuit SR are different, there is no significant difference in the load on the control line GL.

FIG. 6 is a diagram illustrating a timing chart of the control circuit for driving the pixel circuit. When the clock signal CLK rises (falls as a modification), the pulse signal Q moves to the next-stage unit circuit SR. The timing at which the input of the enable signal E is started (at least the rising timing) is later than the timing at which the input of the pulse signal Q is started. The enable circuit EN outputs the control signal G based on the logical product of the pulse signal Q and the enable signal E.

According to the present embodiment, the delay of the pulse signal Q is reset at the timing of the enable signal E input to the enable circuit EN at the node between the output from the shift register 60 and the input to the enable circuit EN, even though the delay amount varies due to the uneven load. Therefore, even though the shift register 60 is separated from the control line GL (scanning line), it is possible to provide a configuration in which the variation in the delay and the amount of bluntness of the control signal G hardly occurs.

Second Embodiment

Figure 7:
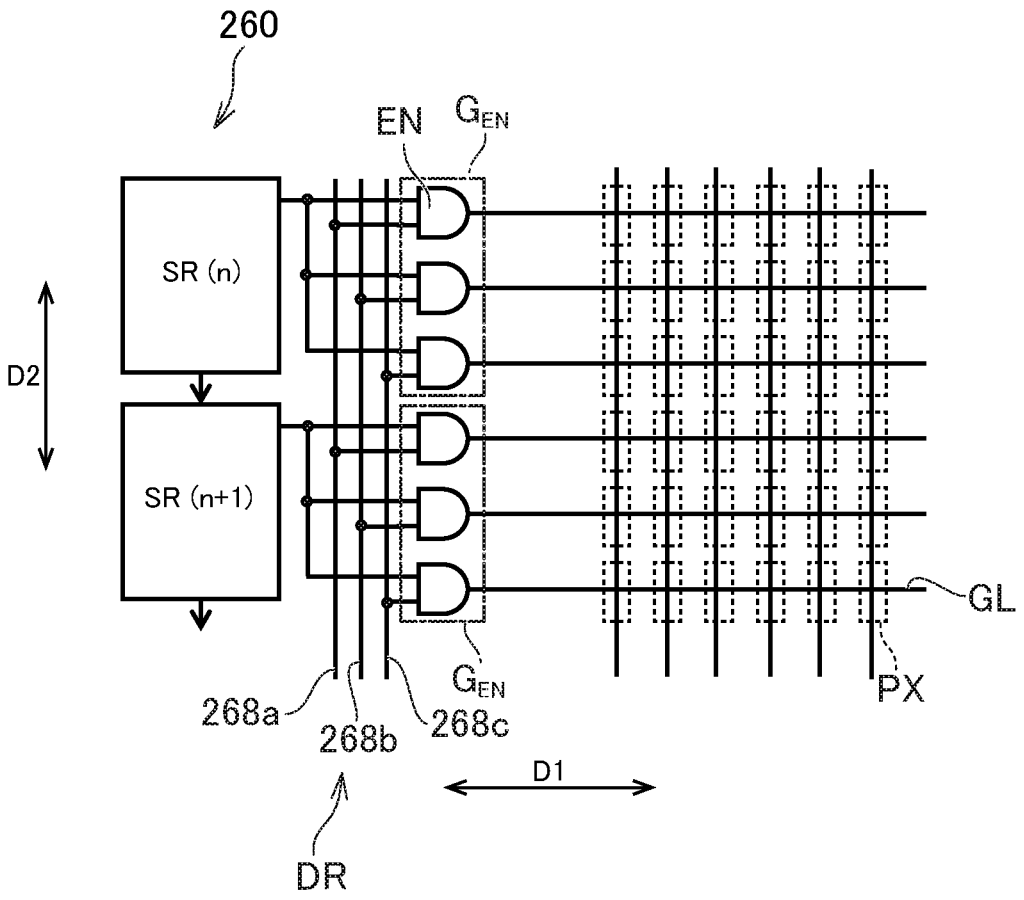
FIG. 7 is a diagram illustrating a control circuit and a pixel circuit according to a second embodiment to which the present invention is applied.

FIG. 7 is a diagram illustrating a control circuit and a pixel circuit according to a second embodiment to which the present invention is applied. The plurality of pixel circuits PX are arranged in a plurality of rows in the first direction D1. Several pixel circuits PX are arranged in a line in each row. Several pixel circuits PX arranged in a line in the first direction D1 are connected to one control line GL.

The plurality of enable circuits EN are divided into a plurality of groups $G_{EN}$. One group $G_{EN}$ includes two or more enable circuits EN. One unit circuit SR is connected in parallel to each of two or more enable circuits EN forming one group $G_{EN}$. Two or more enable lines 268*a*, 268*b*, and 268*c* are connected to the plurality of enable circuits EN. In the same group $G_{EN}$, two or more enable circuits EN are connected to different enable lines 268*a*, 268*b*, and 268*c*. Each of the enable lines 268*a*, 268*b*, and 268*c* is connected to one enable circuit EN included in each of the different groups $G_{EN}$.

Figure 8:
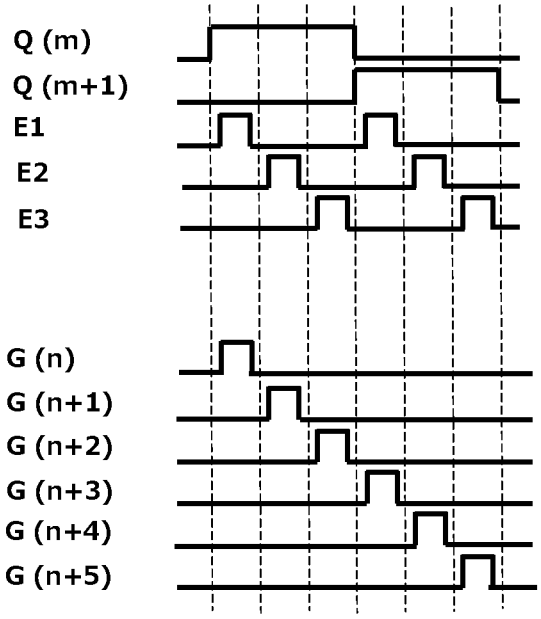
FIG. 8 is a diagram illustrating a timing chart of the control circuit illustrated in FIG. 7.

FIG. 8 is a diagram illustrating a timing chart of the control circuit illustrated in FIG. 7. In the present embodiment, two or more control signals G with different timings are output based on the logical product of one pulse signal Q and two or more enable signals E1, E2, and E3 with different timings. The pulse width of the pulse signal Q is wider than that illustrated in FIG. 6. The enable signal E is input to the two or more enable lines 268*a*, 268*b*, and 268*c* at different timings. Since one pulse signal Q is divided and output into two or more control signals G, the control circuit DR has a function of a multiplexer. Although the number of enable lines 268*a*, 268*b*, and 268*c* increases as compared with the first embodiment, the number of stages of a shift register 260 can be reduced. The other contents correspond to the contents described in the first embodiment.

Third Embodiment

Figure 9:
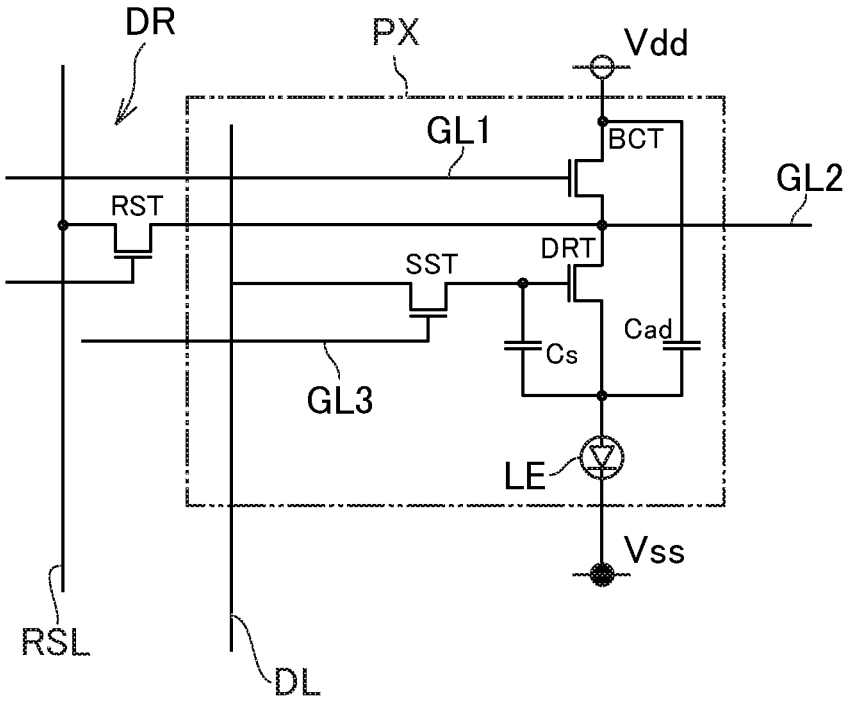
FIG. 9 is a detailed view of a pixel circuit according to a third embodiment to which the present invention is applied.

FIG. 9 is a detailed view illustrating a configuration of a pixel circuit according to a third embodiment that is different from that of FIG. 5. An output switch transistor BCT is connected in series with a driver transistor DRT and the light emitting element LE between the power supply voltage Vdd and the power supply voltage Vss, and has a gate electrode connected to a control line GL1. A pixel switch transistor SST has a gate electrode connected to a control line GL3, one of the source and drain electrodes connected to the video signal line DL, and the other of the source and drain electrodes connected to a storage capacitor Cs. In the pixel circuit of FIG. 9, a plurality of different control lines (GL1, GL2, and GL3) are used to control one pixel.

Figure 10:
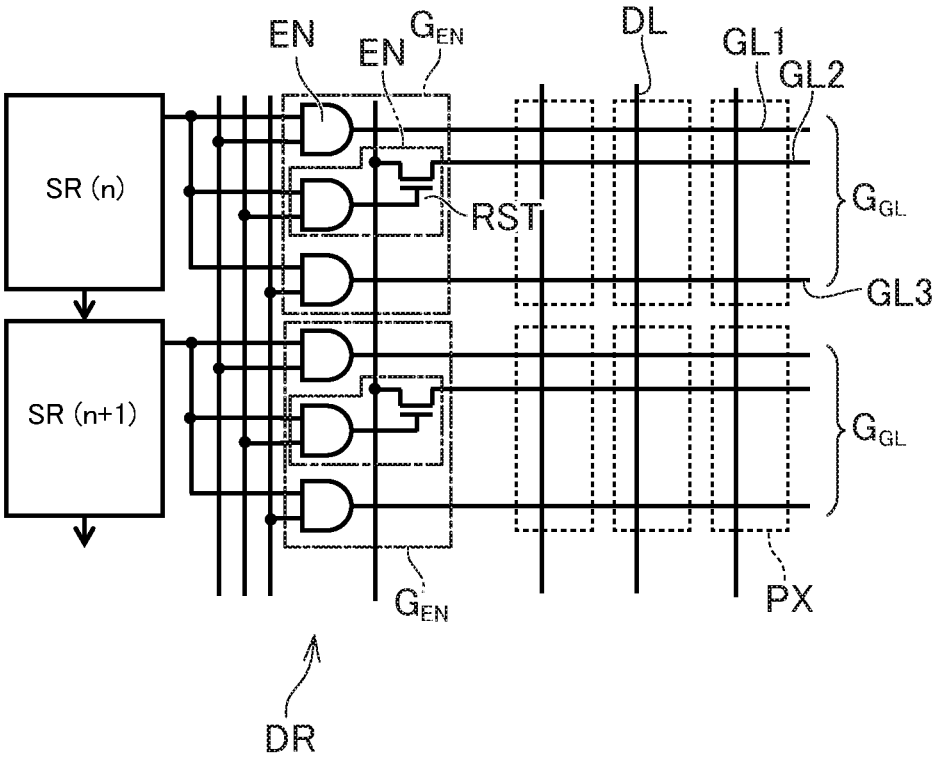
FIG. 10 is a diagram illustrating a control circuit and the pixel circuit according to a third embodiment to which the present invention is applied.

FIG. 10 is a diagram illustrating a control circuit and the pixel circuit according to the third embodiment to which the present invention is applied. The plurality of control lines GL are divided into a plurality of groups GEL. One group GEL includes two or more (three in this example) control lines (GL1, GL2, and GL3). The control lines GL1, GL2, and GL3 of one group $G_{GL}$ are connected to the enable circuits EN of one group $G_{EN}$, respectively. At least one enable circuit EN in each group $G_{EN}$ includes an AND circuit and another element (reset switch transistor RST). The enable circuits EN of one group $G_{EN}$ are connected in parallel to one unit circuit SR. The plurality of pixel circuits PX are arranged in a plurality of rows in the first direction D1. Several pixel circuits PX are arranged in a line in each of the plurality of rows. Several pixel circuits PX arranged in a line in the first direction D1 are connected to the control lines GL1, GL2, and GL3 of one group $G_{GL}$.

The gate electrode of the driver transistor DRT is connected to the storage capacitor Cs. The drain electrode of the driver transistor DRT is connected to the reset switch transistor RST included in the control circuit DR via the control line GL2. The source electrode of the driver transistor DRT is connected to one electrode of the light emitting element LE. The other electrode of the light emitting element LE is connected to the power supply voltage Vss common to all the pixel circuits PX and is kept at a predetermined potential.

The reset switch transistor RST switches between conduction and non-conduction between the control line GL2 and a reset potential line RSL according to the pulse signal Q (FIG. 14) output from the unit circuit SR illustrated in FIG. 10. In the conductive state, the output of the control signal GL2 (FIG. 14) to the control line GL2 causes the charge from the light emitting element LE to be drawn out to the reset potential line RSL and initialized.

The pixel switch transistor SST switches between conduction and non-conduction between the video signal line DL and the gate electrode of the driver transistor DRT according to the control signal G (FIG. 8) output to the control line GL3. In the case of the conductive state, the video signal is taken into the gate electrode of the driver transistor DRT via the video signal line DL and stored in the storage capacitor Cs. The output switch transistor BCT switches between conduction and non-conduction between the power supply voltage Vdd and the drain electrode of the driver transistor DRT according to the control signal G (FIG. 8) output to the control line GL1.

Figure 14:
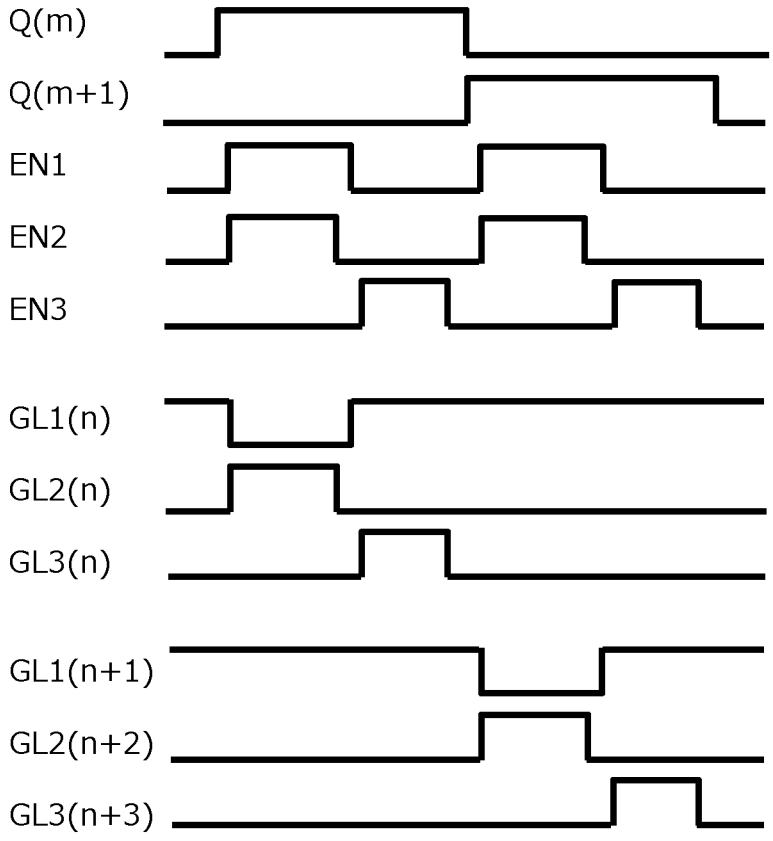
FIG. 14 is a diagram illustrating a timing chart of the pixel circuit illustrated in FIG. 9.

FIG. 14 illustrates an example of a timing chart for driving the pixel circuit illustrated in FIG. 9. As in FIG. 8, a pulse to be output to each control line is generated by the logical product of one pulse signal Q and each of the enable signals E1, E2, and E3. Since the enable signals E1, E2 and E3 are independent of each other, it is possible to obtain an output such that the output timings of some or all of the pulses overlap each other as illustrated in FIG. 14. Although the logical opposite of some outputs differs in FIG. 14, these may be generated by appropriately adding an inversion inside the enable circuit.

Fourth Embodiment

Figure 11:
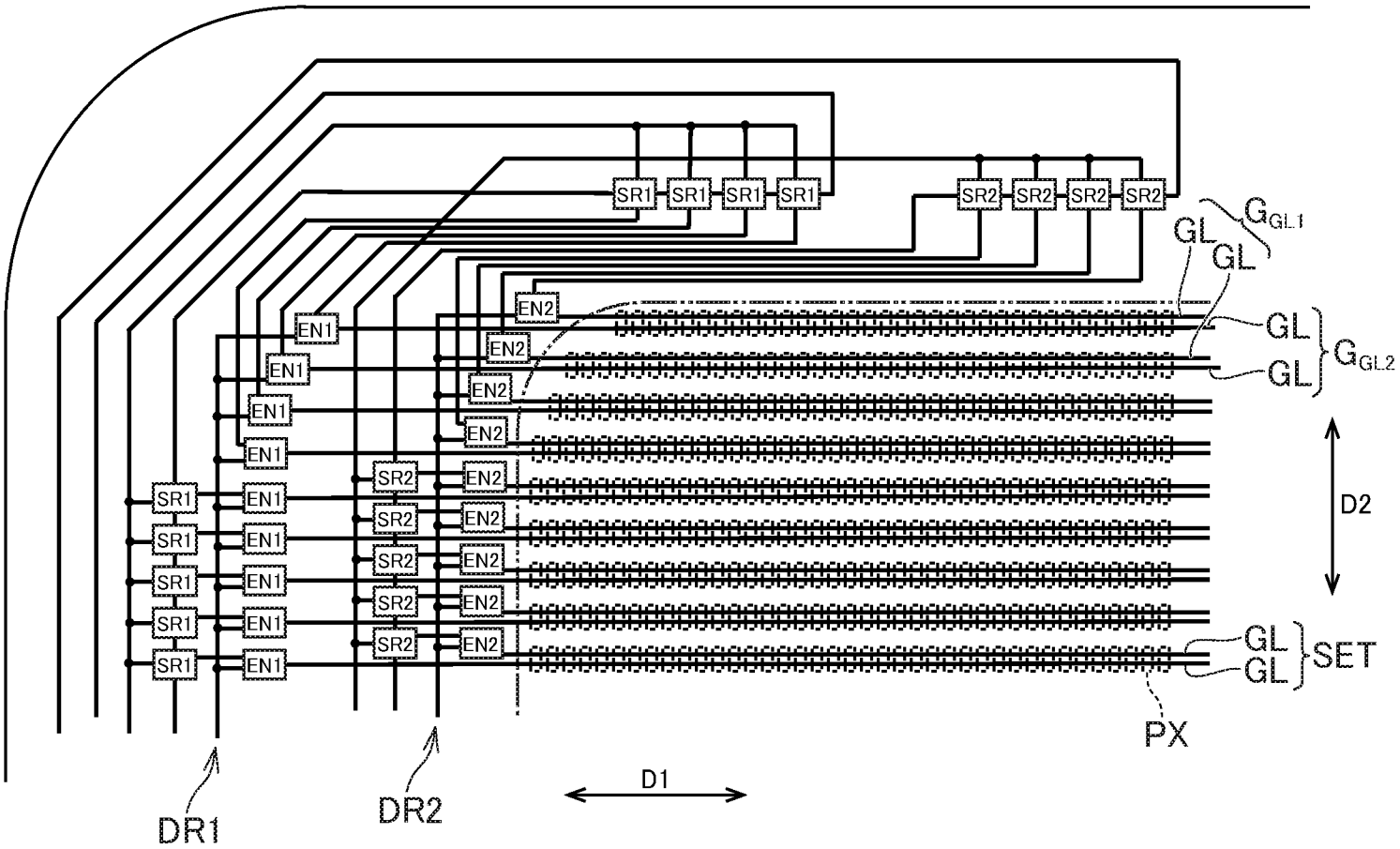
FIG. 11 is a diagram illustrating a control circuit and a pixel circuit according to a fourth embodiment to which the present invention is applied.

FIG. 11 is a diagram illustrating a control circuit and a pixel circuit according to a fourth embodiment to which the present invention is applied. The control circuit includes two or more control circuits DR1 and DR2. One unit circuit SR1 (SR2) is connected to one enable circuit EN1 (EN2). The plurality of pixel circuits PX are arranged in a plurality of rows in the first direction D1. Several pixel circuits PX are arranged in a line in each of the plurality of rows.

The plurality of control lines GL are divided into a plurality of groups $G_{GL1}$ and $G_{GL2}$. The control line GL constituting one group $G_{GL1}$ ($G_{GL2}$) is connected to one of any control circuit DR1 (DR2). The plurality of control lines GL are divided into a plurality of sets SET. The control lines GL constituting one set SET include control lines GL of different groups $G_{GL1}$ ($G_{GL2}$) one by one. The pixel circuits PX arranged in one row are connected to one set SET of control lines GL. The other contents correspond to the contents described in the first embodiment.

Other Embodiments

Figure 12:
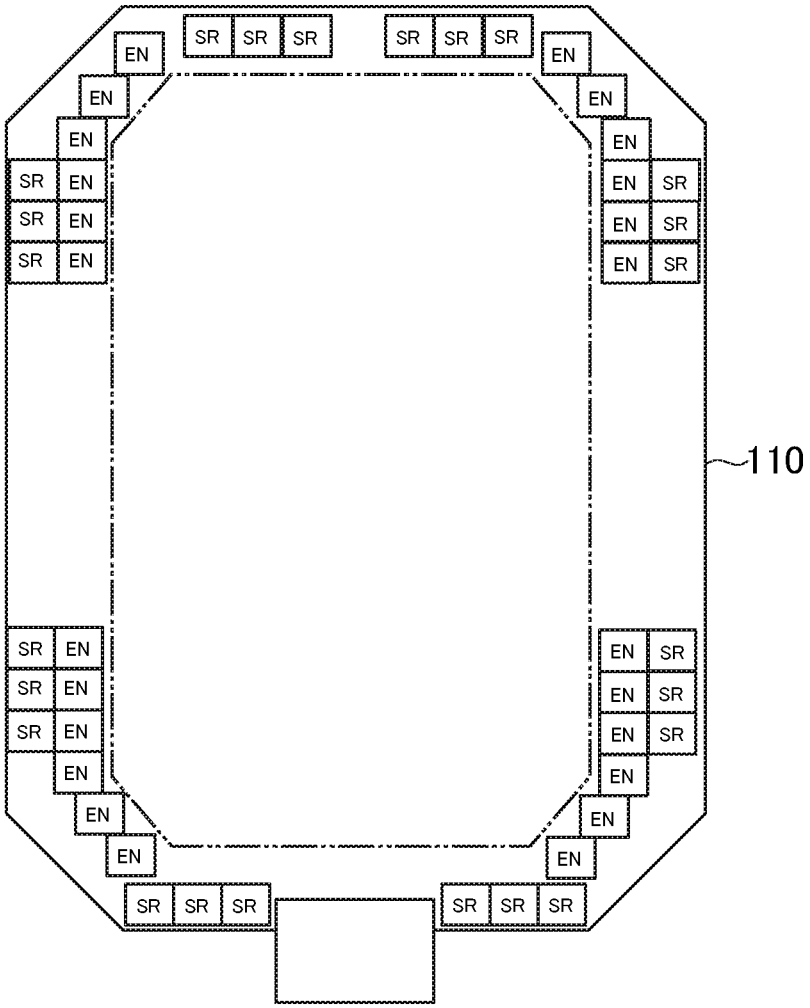
FIG. 12 is a diagram illustrating another embodiment.
Figure 13:
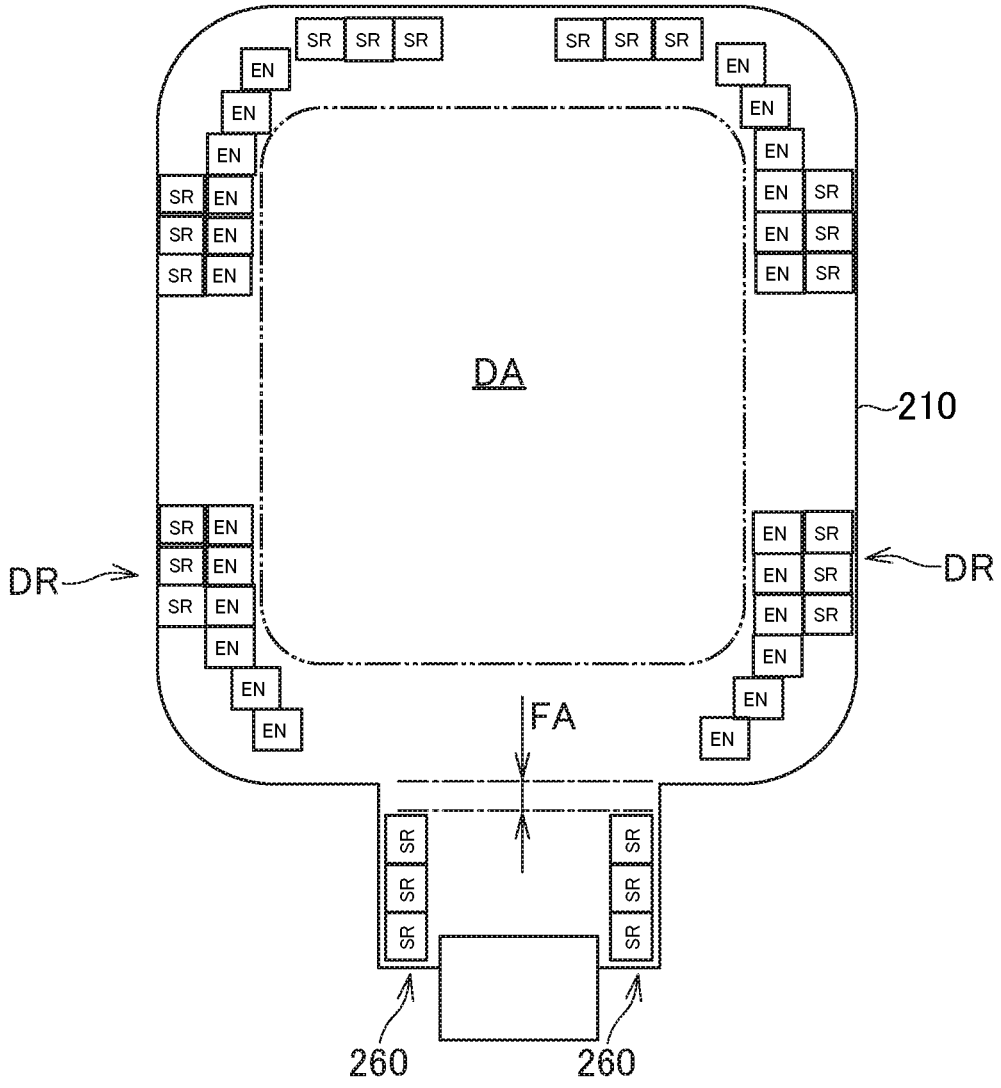
FIG. 13 is a diagram illustrating another embodiment.

FIGS. 12 and 13 are diagrams illustrating other embodiments. In the example of FIG. 1, the outer shape of the corner portion of the substrate 10 is curved, and the outer shape of the corner portion of the display area DA is also curved. On the other hand, in the example of FIG. 12, the outer shape of a substrate 110 is a polygon, and the outer shape of the display area DA is also a polygon. In each case, the outer shape of the corner portion is a straight line.

The display device illustrated in FIG. 13 is used by bending a part of a substrate 210. The control circuit DR is arranged in an area beyond the bending area FA from the side next to the display area DA. The shift register 260 includes some unit circuits SR located on the display area DA side of the bending area FA, and some other unit circuits SR located on the opposite side of the bending area FA from the display area DA.

The display device is not limited to the organic electroluminescence display device, and may be a display device including a light emitting element such as a quantum-dot light emitting diode (QLED) in each pixel, or a liquid crystal display device.

While there have been described what are at present considered to be certain embodiments, it will be understood that various modifications may be made thereto, and it is intended that the appended claims cover all such modifications as fall within the true spirit and scope of the invention.

What is claimed is:

1. A display device comprising:

a display area in which a plurality of pixel circuits respectively corresponding to a plurality of pixels are arranged in a first direction and a second direction intersecting each other;

a peripheral area outside the display area;

a plurality of control lines connected to the plurality of pixel circuits in the display area and extending in the first direction to reach the peripheral area; and a control circuit for sequentially selecting the plurality of control lines in the peripheral area, wherein the control circuit includes a shift register including a plurality of unit circuits connected in multiple stages so that a pulse signal is sequentially moved and output, a plurality of enable circuits connected to the plurality of unit circuits so that the pulse signal is input, and a plurality of connection lines connecting the plurality of unit circuits and the plurality of enable circuits, the plurality of enable circuits are respectively adjacent to the display area in the first direction and connected to the plurality of control lines to output a control signal corresponding to the pulse signal, the plurality of unit circuits include a first group of unit circuits located adjacent to the display area in the first direction, and a second group of unit circuits located adjacent to the display area in the second direction, the plurality of connection lines include a first group of connection lines connected to the first group of unit circuits, and a second group of connection lines connected to the second group of unit circuits, and the connection lines of the second group are longer than the connection lines of the first group.

2. The device according to claim 1, wherein
the outer shape of the display area includes a first side extending in the first direction, a second side extending in the second direction, and a third side extending obliquely with respect to the first direction and the second direction and connecting the first side and the second side.

3. The device according to claim 2, wherein
at least a part of the third side has an arc shape.

4. The device according to claim 2, wherein
the peripheral area has a uniform width adjacent to the first side, the second side, and the third side.

5. The device according to claim 1, wherein
the control circuit includes an enable line for inputting an enable signal to the plurality of enable circuits, and
each of the plurality of enable circuits is configured to output the control signal based on the pulse signal and the enable signal.

6. The device according to claim 5, wherein
the timing when the input of the enable signal is started is later than the timing when the input of the pulse signal is started.

7. The device according to claim 5, wherein
the plurality of enable circuits are divided into a plurality of groups, and each of the plurality of groups includes an enable circuit assembly including two or more corresponding ones of the plurality of enable circuits,
each of the plurality of unit circuits is connected to the enable circuit assembly included in a corresponding one of the plurality of groups,
the enable line includes two or more enable lines,
each of the two or more enable lines is connected to a corresponding one of the enable circuit assemblies included in each of the plurality of groups, and
the enable signal input to one of the two or more enable lines and the enable signal input to another one of the two or more enable lines are configured to be input at different timings.

8. The device according to claim 7, wherein
the plurality of pixel circuits are arranged in the first direction in a plurality of rows, and include a pixel circuit assembly arranged in each of the plurality of rows, and
the pixel circuit assembly is connected to a corresponding one of the plurality of control lines.

9. The device according to claim 7, wherein
the plurality of pixel circuits are arranged in the first direction in a plurality of rows, and include a pixel circuit assembly arranged in each of the plurality of rows,
the plurality of control lines are divided into a plurality of groups, and each of the plurality of groups includes a control line assembly including two or more corresponding ones of the plurality of control lines, and
the pixel circuit assembly is connected to the control line assembly included in a corresponding one of the plurality of groups.

10. The device according to claim 9, wherein
the control line assembly is connected to the enable circuit assembly.

11. The device according to claim 1, wherein
each of the plurality of unit circuits is connected to a corresponding one of the plurality of enable circuits.

12. The device according to claim 1, wherein
the plurality of pixel circuits are arranged in the first direction in a plurality of rows, and include a pixel circuit assembly arranged in each of the plurality of rows,
the control circuit includes two or more control circuits,
the plurality of control lines are divided into a plurality of groups, and a control line assembly constituting each of the plurality of groups is connected to a corresponding one of the two or more control circuits,
the plurality of control lines are divided into a plurality of sets, and the control line assembly constituting each of the plurality of sets includes a corresponding one of each control line assembly constituting each of the plurality of groups, and
the pixel circuit assembly is connected to the control line assembly constituting a corresponding one of the plurality of sets.

* * * * *